United States Patent [19]

Akkerman

[11] Patent Number: 4,522,259

[45] Date of Patent: Jun. 11, 1985

[54] WELL APPARATUS

[75] Inventor: Neil H. Akkerman, Kingwood, Tex.

[73] Assignee: AVA International Corporation, Houston, Tex.

[21] Appl. No.: 489,827

[22] Filed: Apr. 29, 1983

[51] Int. Cl.[3] ..... E21B 23/02

[52] U.S. Cl. ..... 166/237; 166/217

[58] Field of Search ..... 166/237, 217, 113, 123, 166/125, 322, 117.5, 381, 382; 403/108, 109, 326, DIG. 7; 285/39

[56] References Cited

U.S. PATENT DOCUMENTS 2,887,163 5/1959 McGowen, Jr. et al. ..... 166/217

3,507,329 4/1970 Stone, Jr. ..... 166/217

*Primary Examiner*—Stephen J. Novosad

*Assistant Examiner*—Thuy M. Bui

*Attorney, Agent, or Firm*—Vaden, Eickenroht, Thompson & Jamison

[57] ABSTRACT

There are disclosed two embodiments of well apparatus each including a well tool adapted to be lowered into and locked within a landing nipple of a well string, together with a running tool adapted to be connected to the well tool for lowering it into locking position and then causing it to be so locked within the nipple, following which the running tool is released from the well tool for retrieval from the well string.

55 Claims, 14 Drawing Figures

Fig. 1A
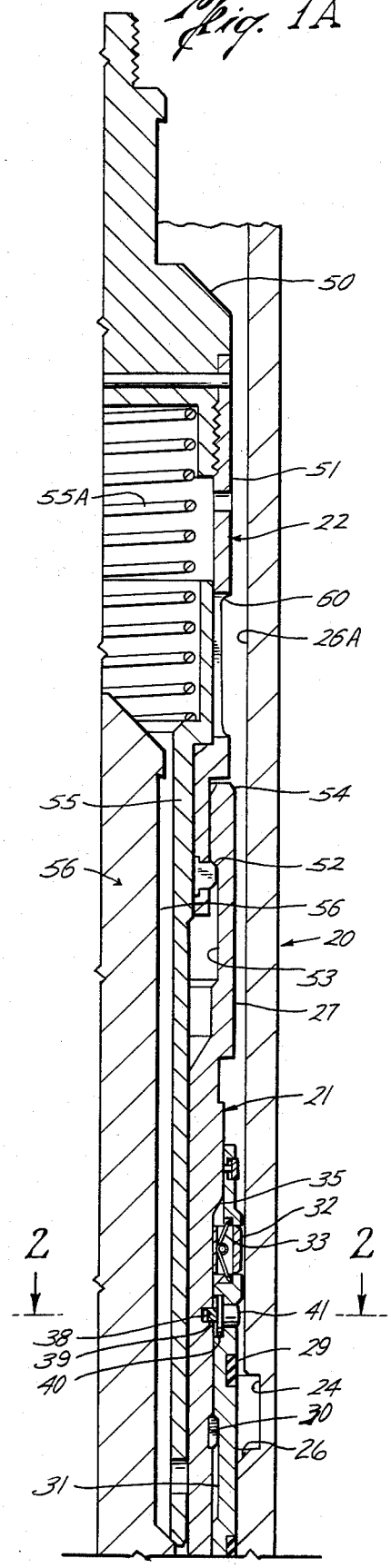
Fig. 1B
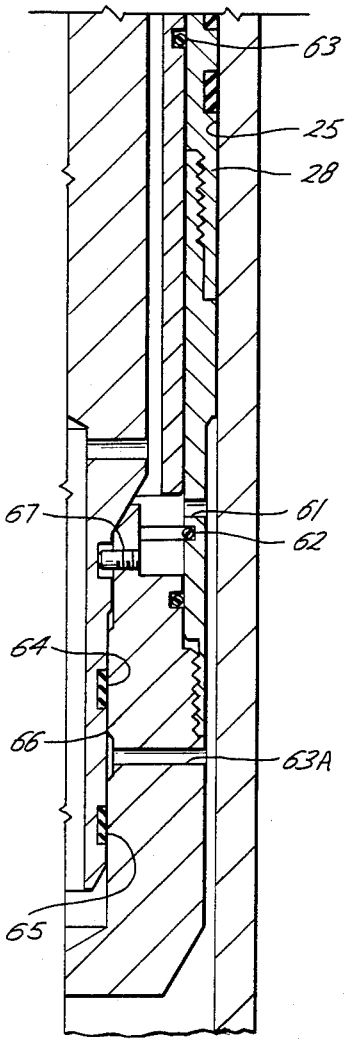
Fig. 3
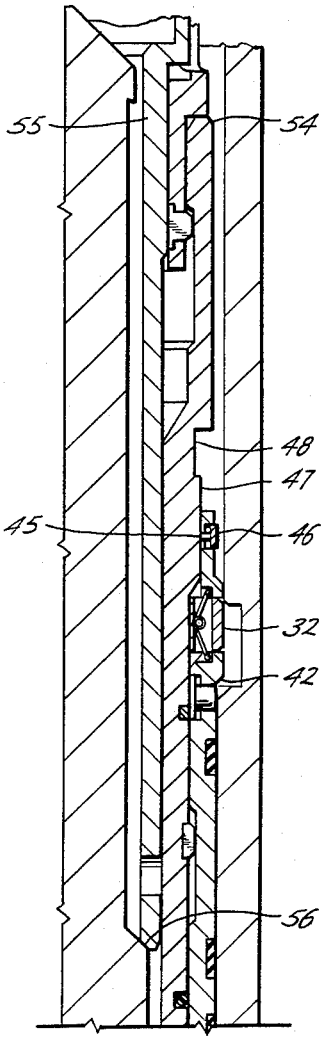
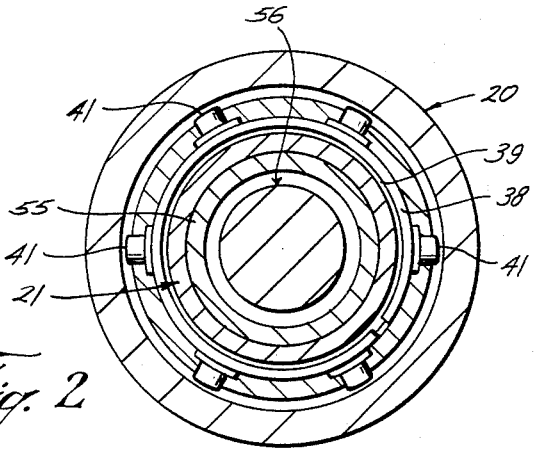
Fig. 2

Fig. 4A
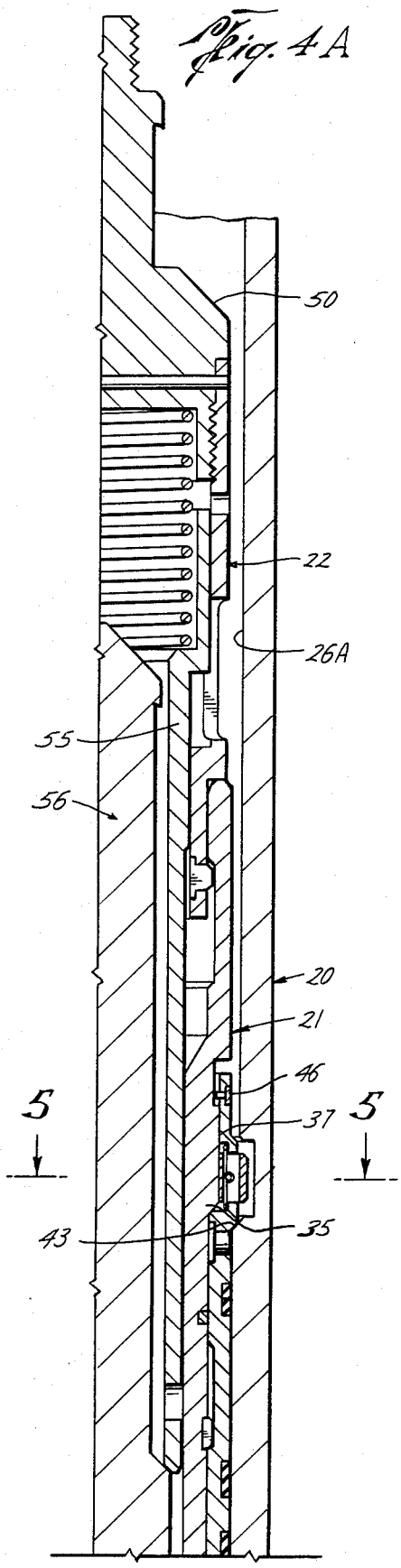
Fig. 4B
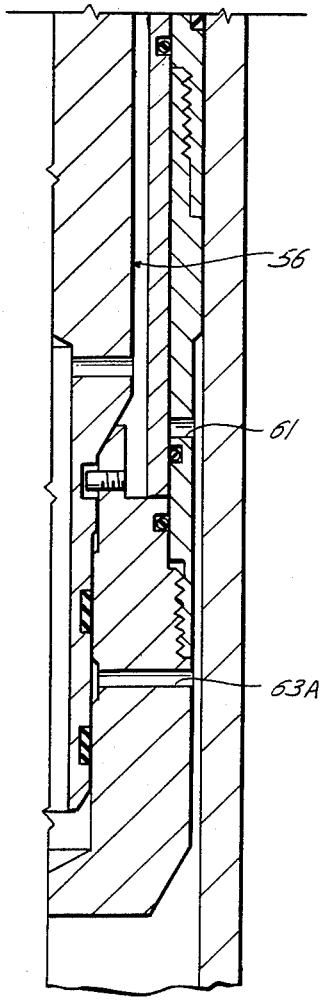
Fig. 6
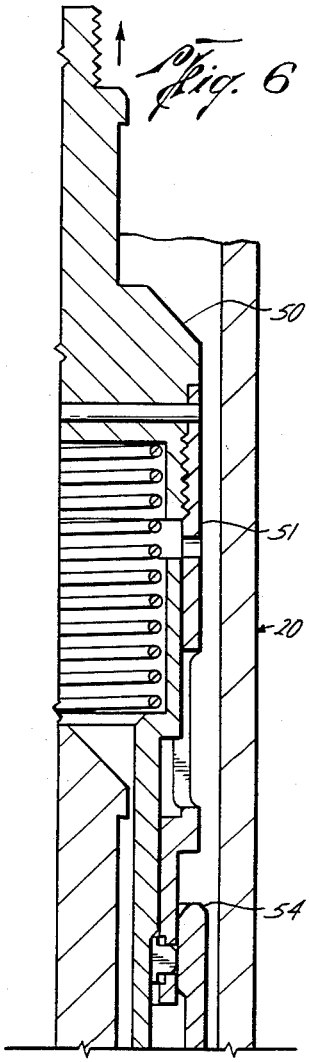
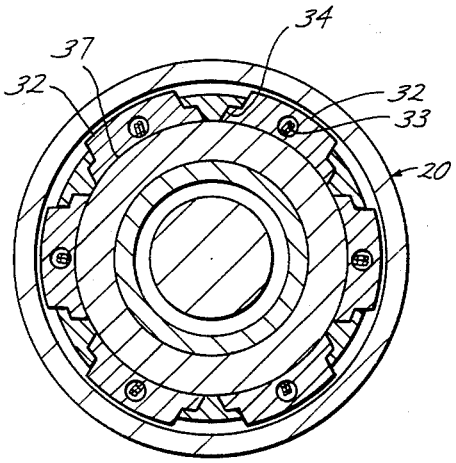
Fig. 5

68
56
67
64
65
61
67
20

69
23
20
52
53
21
32
41
31

WELL APPARATUS

This invention relates generally to apparatus of the type in which a well tool is to be lowered into and locked within a well conduit. More particularly, it relates to apparatus of this type in which the well tool is lowered by means of a wire line running tool which, when the well tool is so lowered, may be manipulated in order to cause locking means carried by the tool to be locked with a locking groove in the well conduit, and which, when the tool is so locked, may be released from the well tool for retrieval from the well bore.

Typically, the well conduit is a so-called landing nipple connected as part of the well string and having a seal bore therein which, when the locking means is locked within the locking groove in the nipple, is sealably engaged by the well tool or by another tool connected to and lowered with the well tool in order to close the well string or otherwise control flow therethrough. Alternatively, the well tool to be locked within the nipple may be an instrument of some type which is not intended to control flow through the well string and thus need not sealably engage the seal bore of the nipple.

In the prior apparatus of this type, the well tools have been locked within the well conduit by means of collets, keys, dogs, or other locking means which are caused to expand into the locking groove in the nipple in response to manipulation of the running tool following engagement of the well tool with a shoulder in the nipple, which may be of larger or greater diameter than the seal bore. In all such apparatus of which I am aware, however, the well tools are of such construction that they may instead engage recesses or restrictions in the well string other than the shoulder or shoulders deliberately provided for that purpose. In such a case, the well tool may be locked at some unintended location with the well string and the running tool released from the well tool without knowing that the tool is not properly located.

These problems in properly locating the well tool are, of course, compounde, when, as in usually the case, the nipple is many thousands of feet below the surface, and the running tool must be raised and lowered in the process of locking the well tool at its intended location within the nipple. Also, even if the well tool is properly located, it may be necessary to impart jars to the well tool through the running tool in order to expand the locking means into the locking groove.

The primary object of this invention is to provide well apparatus to the type described in which it is virtually impossible for the well tool to be located other than within the intended nipple.

Another object is to provide such apparatus in which the locking means is caused to expand into the locking groove of the nipple and the running tool released without the need for imparting jars to the well tool.

Still another object is to provide such apparatus in which the locking means may be expanded and the running tool released solely in response to lowering of the wire line.

Yet a further object is to provide such apparatus in which the wire line tool may be retrieved from the well tool, when locked, merely by upward jarring and lifting of the wire line.

These and other objects are accomplished, in accordance with the illustrated embodiments of the invention, by means of a well tool having sensing means carried by the body of the tool for movement into engagement with the seal bore or another cylindrical bore in the nipple as the body is lowered by means of a running tool into the well conduit, and means which is responsive to such movement of the sensing means for enabling normally retracted locking means carried about the body to be expanded into the locking groove of the nipple, and when the locking means is so expanded, enabling the running tool to be released from connection to the body upon further manipulation of the running tool. Although there may be many cylindrical surfaces within a well string above the bore in the nipple to be engaged by the sensing means, as long as none are of a reduced diameter deliberately provided for the purposes of this invention, the well tool cannot be locked or the running tool retrieved unless the intended cylindrical surface is sensed.

The body of the well tool is provided with means to which a wire line retrieving tool may be connected together with means responsive to raising of the retrieving tool, when so connected to the body, for causing the locking means to return to retracted position, whereby the well tool may be lifted from the well conduit with the retrieving tool. Means are also provided for holding the locking means in locking position automatically in response to its expansion into the locking groove, and for releasing the holding means in response to jarring of the tool through the retrieving tool, as during upward movement thereof to retrieve the well tool.

Thus, the body of the well tool includes means which is shiftable from a first position to a second position to cause the normally retracted locking means to be expanded into the locking groove. The shiftable means is held in its first position, as the tool is lowered into the well conduit, and then released for movement into its second position in response to movement of the sensing means into engagement with the cylindrical bore. More particularly, a means is provided for releasing the running tool from connection to the body, whereby the running tool may be raised from the well tool, in response to movement of the shiftable means to its second position upon further manipulation of the running tool.

In the preferred and illustrated embodiment of the invention, the body of the well tool comprises a first member connectible to the running tool for lowering therewith and a second member supported from the first member for lowering therewith, and the locking means which is carried about the body in normally contracted position is caused to expand into the locking groove in response to downward movement of the first member and the running tool with respect to the second member. A means for preventing such downward movement of the first member is released in response to movement of the sensing means into engagement with the bore, and a shoulder on the second member is landable on a seat within the well conduit, following release of the preventing means, so that the first member and running tool may be so lowered with respect to the second member. More particularly, means are also provided for releasing the connection of the first member to the running tool, whereby the running tool may be raised from the well tool, in response to lowering of the first member and running tool with respect to the second member to expand the locking means into the locking groove. Thus the locking means is caused to expand into locking position, and the running tool is released from the well tool, merely in response to a substantially continuous lowering of the running tool and without the need to apply jars to the tool or to manipulate the wire line up and down.

In the preferred and illustrated embodiments of the invention, the first member is provided with the means to which a wire line retrieving tool may be connected in order that the first member may be lifted with respect to the second member to cause the locking means to be returned to contracted position and the first member to be returned to a position supporting the second member. More particularly, the means for holding the locking means in locking position includes means for automatically connecting the first member to the second member in response to lowering of the first member with respect to the second member to expand the locking means, and the connecting means is releasable in response to upward jarring of the first member through the retrieving tool, whereby the first member, and thus the second member and locking means, may be retrieved upon substantially continuous lifting of the retrieving tool.

In each illustrated embodiment of the invention, the means for preventing movement of the first member with respect to the second member comprises normally expanded latch means bridging between the second member and one of the first member and running tool, and the sensing means comprises sensing elements with are carried by the second member in position to be urged by the latch means to an outwardly projecting sensing position. More particularly, movement into the latch means is yieldable as the sensing elements are forced inwardly upon engagement with the bore to release the first member and running tool for lowering with respect to the second member. The expanding means preferably comprises oppositely facing shoulders on the outer sides of the first and second members above and below the locking means, and one of the shoulders has a surface to wedge the locking means outwardly as the shoulders move relatively toward one another.

In one embodiment of the invention, the lower end of the first member extends within the upper end of the second member, and the preventing means comprises normally expanded latch means bridging between the first and second members. Thus, the latch means is yieldable as the sensing elements are forced inwardly upon movement into engagement with the bore to release the first member and running tool for lowering with respect to the second member. The running tool for this embodiment of the invention is seatable on the first member and includes latch means for shifting between latching and unlatching positions beneath a shoulder of the first member. A sleeve is carried by the running tool for seating on the second member, and the running tool is vertically shiftable with respect to the sleeve between an upper position in which the latch means is held by the sleeve in latching position and a lower position in which the latch means is released for movement to unlatching position.

In another embodiment of the invention, the lower end of the first member surrounds the upper end of the second member, and the preventing means comprises normally expanded latch means bridging between the running tool and second member. More particularly, in this embodiment, the latch means is yieldable as the sensing elements are forced inwardly upon movement into engagement with the seal bore to release the first member and running tool for lowering with respect to the second member. In this latter embodiment, the running tool is seatable on the first member and includes normally expanded latch means which is disposable within a gap between shoulders on the inner sides of the first and second members, and which is contractible inwardly, upon lowering the first member and the running tool with respect to the second member, so as to release the running tool for removal from the well bore as the gap is decreased.

In the first-mentioned embodiment of the invention, the well tool is a plug which is adapted to close off the well string, but which has fluid bypass means which permits it to be lowered through a column of fluid in the well string, or to be retrieved through a column of well fluid in the well bore. Thus, the lower end of the second member is closed except for first and second port means, with the first port means being open to permit well fluid to flow therethrough as the well tool is being lowered and then closed as the first member is lowered with respect to the second member, and the second port means being closed by a plug landed within the second member, so that, with the first port means closed, the well tool closes the well conduit. The plug is liftable from the second member to open the second port means prior to retrieval of the well tool.

In the drawings, wherein like reference characters are used throughout to designate like parts:

FIGS. 1A and 1B are vertical half sectional views of upper and lower prortions of the first-described embodiment of apparatus constructed in accordance with the present invention, and during lowering of the running tool and well tool into the the well conduit;

FIG. 2 is a cross-sectional view of the apparatus, as seen along broken lines 2—2 of FIG. 1A;

FIG. 3 is a view similar to FIG. 1A, but upon further lowering of the running tool and well tool to a level in which the sensing elements have entered the upper end of the seal bore of the well conduit so as to release the running tool and first member of the well tool for downward movement with respect to the second member thereof;

Figure 7:
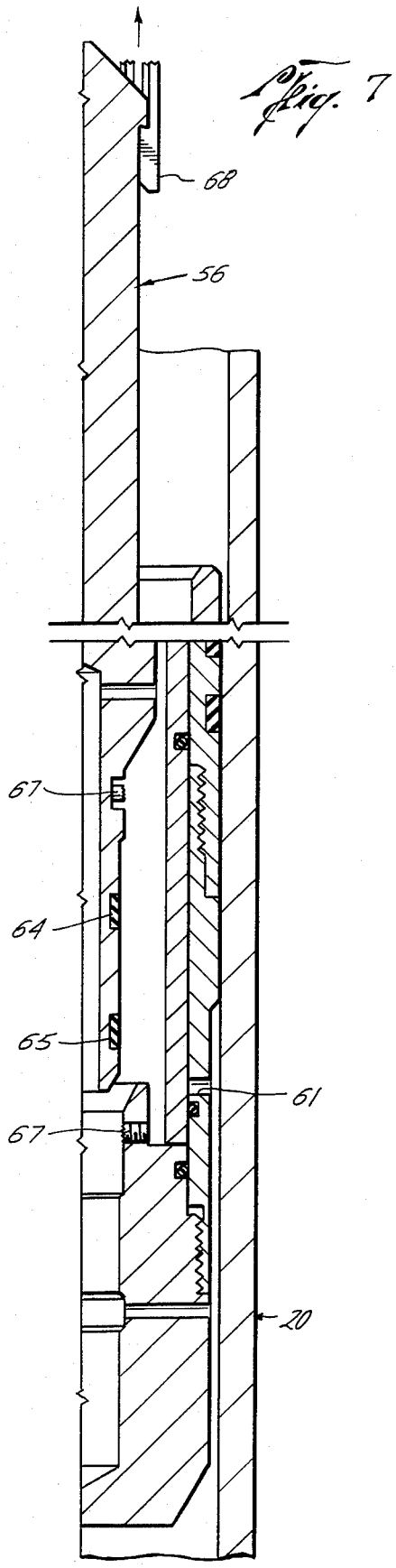
Figure 8:
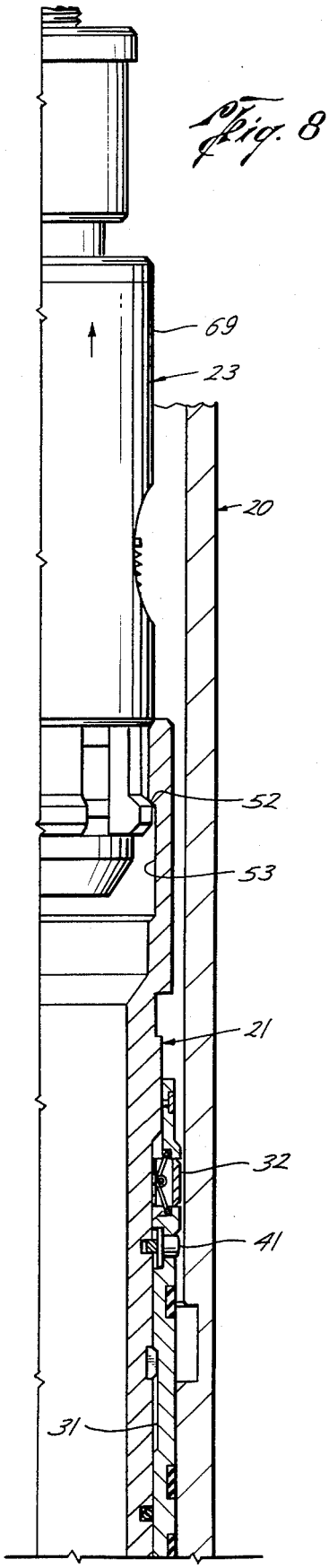
Figure 9:
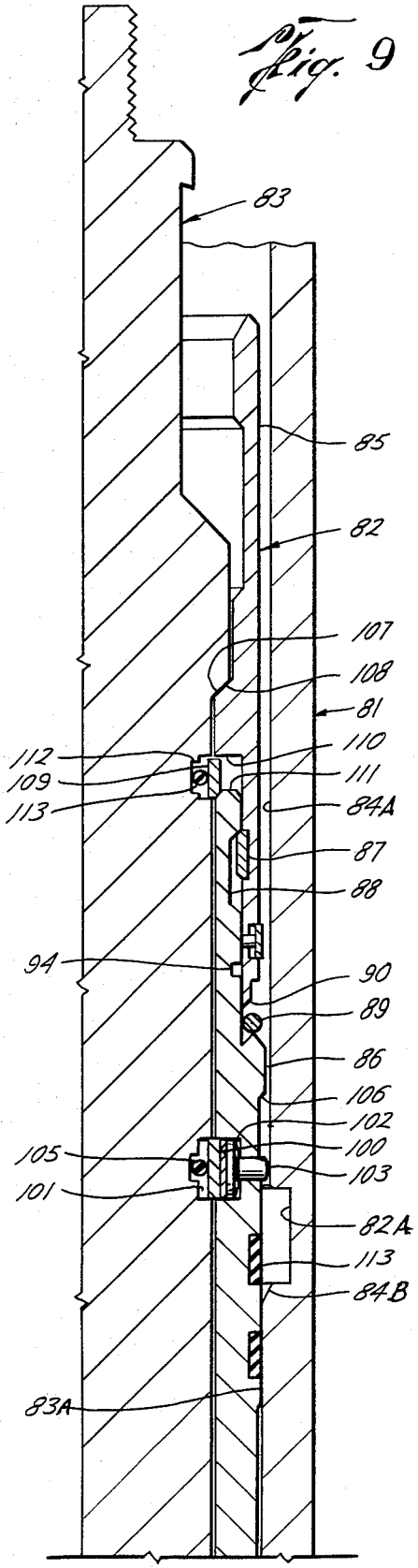
Figure 10:
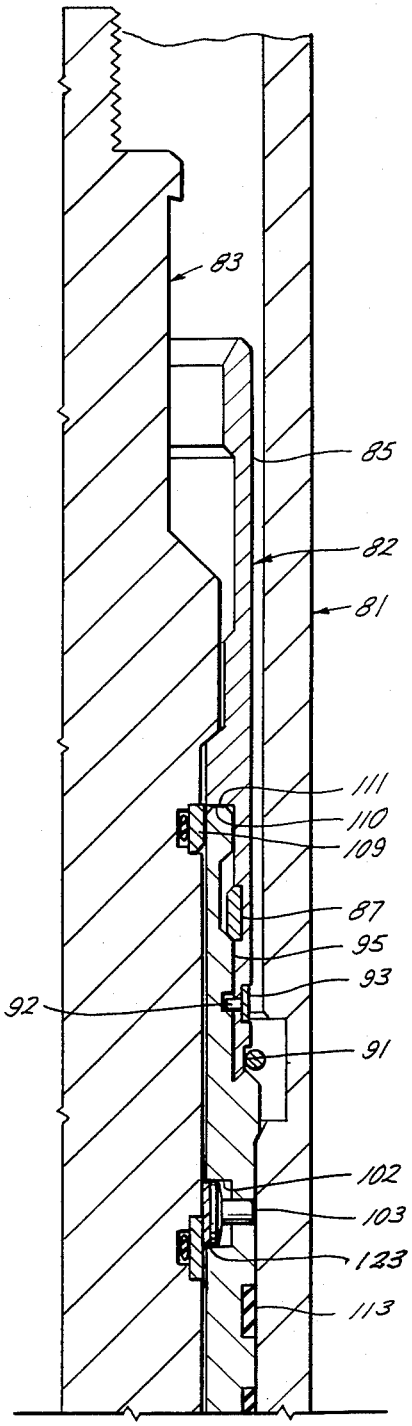
Figure 11:
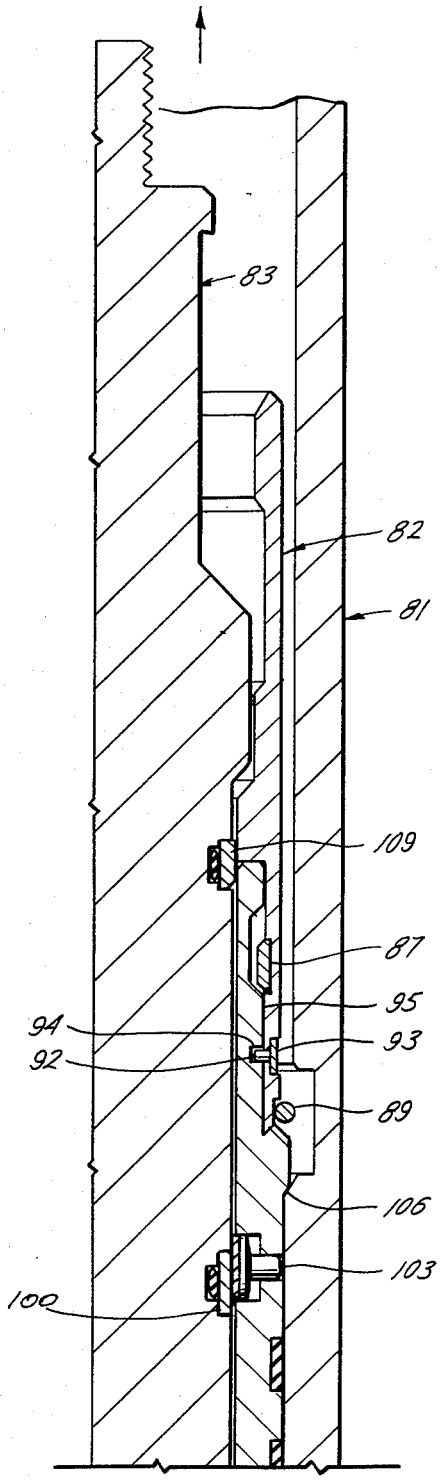
Figure 12:
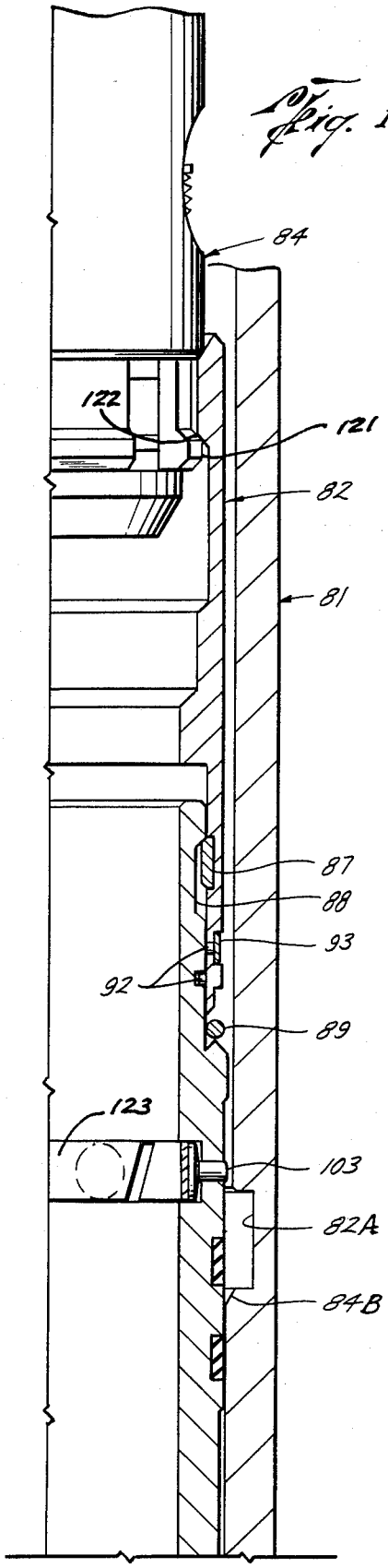

FIGS. 4A and 4B are additional half sectional views of the upper and lower portions of the apparatus, similar to FIGS. 1A and 1B, but upon further lowering of the well tool to land a shoulder of the second member on an upwardly facing seat within the well conduit, and lowering of the first member with the running tool with respect to the second member so as to force the locking means carried by the well tool into locking position within a locking groove in the well conduit, as shown in FIG. 4A, and close an equalizing port in the lower end of the second member, as shown in FIG. 4B;

FIG. 5 is a cross-sectional view of the apparatus, as seen along broken lines 5—5 of FIG. 4A;

FIG. 6 is a view similar to the upper end of FIGS. 1A and 4A, but during raising of the running tool to permit it to be retrieved from the well string;

FIG. 7 is a further view of the well tool and conduit, interrupted intermediate their ends, and during retrieval of an inner plug from within the lower end of the second member of the well tool in order to open another port in the second member and thereby equalize pressure across the well tool prior to retrieving it from the well bore;

FIG. 8 is a vertical sectional view of one-half of the upper portion of the well tool and well conduit upon connection of a retrieving tool to the first member of the well tool and lifting of same to permit the locking means to move to unlocking position and the second member to be supported from the first member to enable retrieval of the well tool along with the retrieving tool;

FIG. 9 is a vertical sectional view of one-half of the other embodiment of well apparatus constructed in accordance with the present invention, during lowering of the well tool with the running tool thereof into the well conduit;

FIG. 10 is a view similar to FIG. 9, but upon further lowering of the well tool to cause the sensing elements to move into engagement with the seal bore of the well conduit so as to release the running tool and the first member from the second member of the well tool, and subsequent lowering of the running tool and first member with respect to the second member so as to expand the locking means into locking position within a locking groove in the well conduit and release the running tool from the second member of the well tool;

FIG. 11 is a view similar to FIGS. 9 and 10, but as the running tool is first raised with respect to the well tool so as to permit it to be retrieved from the well string; and FIG. 12 is another half vertical section of the well tool and well conduit, but upon connection of a retrieving tool to the first member and lifting of the first member with the retrieving tool so as to permit the locking means to return to retracted position and the second member to be supported from the first member in order to retrieve the well tool is retrieved from the well string.

With reference now to the details of the above-described drawings, the embodiment of the well apparatus illustrated in FIGS. 1 to 8 includes a well conduit 20 which may be a landing nipple connected as part of a well string, a well tool 21 adapted to be locked within the conduit 20, and running and retrieving tools 22 and 23 for respectively lowering the well tool 21 into the well conduit and causing it to be locked therein, and then causing the well tool to be unlocked from the well conduit and retrieved therefrom.

The conduit 20 has a locking groove 24 thereabout, a reduced diameter seal bore 25 beneath the locking groove, and an upwardly facing seat in the form of a conically shaped shoulder 26 at the intersection of the lower end of the groove and upper end of the seal bore. As the name implies, the seal bore 25 is polished to provide a surface with which seal means carried by the well tool may sealably engage. The inner diameter 26A of the conduit above the locking groove is of larger diameter than the seal bore, and generally of the same diameter as the well string thereabove, so that, as will be more apparent from the description to follow, the well tool may be lowered into a position for locking in the landing nipple.

The well tool 21 includes a body comprising a first tubular member 27 adapted for releasable connection to each of the running tool 22 and retrieving tool 23, and a second tubular member 28 adapted to be supported by the first tubular member for raising and lowering therewith. As shown, the lower end of the first member and upper end of the second member are arranged telescopically of one another, and, in this embodiment of the invention, the lower end of the first member extends within the upper end of the second member. As will be described in detail to follow, the first member is adapted to be raised and lowered with respect to the second member so as to selectively cause locking means 32 carried by the well tool to be moved into and out of locking groove 24.

In the embodiment of FIGS. 1 to 8, well tool 21 is a plug adapted to close off the nipple to flow therethrough and thus has seal rings 29 carried thereabout for sealably engaging the seal bore 25 when the well tool is locked within the nipple. Alternatively, the plug and seal rings carried thereby may comprise parts connected to the well tool. Also, of course, this invention also contemplates that the well tool, or parts to be connected to it, may be measuring devices or the like, in which case they would not ordinarily sealably engage with the seal bore therethrough.

As shown, as the well tool is raised or lowered within the well conduit, the second member 28 is supported in a lower or extended position with respect to the first member 27 by means of a "C" ring 30 ring carried about the first member and engaged with the upper end of an annular recess 31 within the second member. As will be understood from the description to follow, the recess is of such length as to permit the first member to be lowered from such upper position (FIG. 1A) to a lower position (FIG. 4A) as the members are contracted with respect to one another so as to cause the locking means to be expanded into the locking groove.

As best shown in FIG. 5, the locking means includes a plurality of locking dogs 32 each mounted for radial movement within a window 34 formed in the second tubular member opposite the outer side of the first tubular member, and urged inwardly by a spring 33 acting between it and the second member. When the first member is in a raised position with respect to the first member as the well tool is being lowered, the dogs are contracted about a reduced diameter surface of the first member beneath a conical shoulder 35 thereof. When the dogs are so contracted, their outer sides do not project from the outer side of the body and thus don't interfere with lowering of the well tool into the nipple.

As the first member is lowered with respect to the second member, conical shoulder 35 on the outer side of the first member serves as an expander surface to wedge the dogs outwardly into locking position within locking groove 24, as shown in FIG. 4A. More particularly, as the first member is lowered further, a diametrically enlarged cylindrical surface 37 thereof above shoulder 35 moves behind the locking dogs to hold them in locking positions. As shown in FIG. 5, dovetails on opposite sides of the locking dogs engage with overhanging flanges on the second member to limit outward movement of the locking dogs in their locking positions.

During lowering of the well tool into the well conduit, "C"-ring 38 carried within a groove 39 about the first tubular member is normally expanded into a recess 40 on the inner side of the second member to bridge between the first and second members so as to hold them in extended position. Although the "C"-ring is shorter than recess 40, and thus permits a limited amount of downward movement of the first member with respect to the second member, it nevertheless prevents sufficient downward movement to cause the expander surface 35 to wedge the locking dogs 32 outwardly into locking position.

Ring 38 is adapted to be moved radially inwardly to a position out of the recess 40, and thus to release the first member for movement downwardly with respect to the second member, by means of a plurality of sensing elements in the form of pins 41 carried by the second member for radial movement within a circle of holes thereabout connecting the recess 40 with the outer side of the second member. Each pin has a flange on its inner end which moves within the recess and engages with the bottom thereof so as to limit its outward movement to a sensing position in which its outer end projects from the outer diameter of the second member, but not substantially beyond the locking dogs. Thus, the dogs move freely into the nipple and into engagement with shoulder 26 above seal bore 25 as the well tool is lowered into a position in which the locking dogs 32 approach a position opposite locking groove 24. More particularly, the shoulder 26 is conically shaped so as to force the sensing elements inwardly, as they move into engagement with the seal bore, so that the flanges on their inner ends force the "C" ring back into the groove 39, and thus out of the recess 40, so as to release the first member for downward movement with respect to the second member.

Continued lowering of the well tool will lower a downwardly facing shoulder 42 on the second member intermediate the sensing elements and the locking dogs onto the seat 26 in the nipple. Thus, still further downward movement of the running tool will lower the first member with respect to the seated second member, and thus cause the locking dogs 32 to be wedged outwardly into locking position and held in such locking position. As the first member continues to move downwardly to the contracted position with respect to the second member shown in FIG. 4A, the expander surface 35 engages with an upwardly facing tapered surface 43 on the second member just beneath the windows which receive the locking dogs. Since the seal rings 29 of the well are beneath the sensing elements, they have of course moved into sealing engagement with the seal bore.

The first member is locked in its lower position with respect to the second member, and thereby holds the locking dogs in locking position, by means of a series of pins 45 which are carried for radial movement within holes in the upper end of the second member. These pins are urged inwardly by means of a normally contracted "C" ring 46 which is received within a recess about the upper end of the second member which surrounds the pins. In the extended position of the first and second members, the inner ends of the pins are engaged with a cylindrical surface 47 about the first member above shoulder 35. However, as the first member moves downwardly into its contracted position with respect to the second member, a groove 48 above the surface 47 of the first member moves opposite the pins 45 to permit them to be moved inwardly into the recess by the "C" spring 46. Thus, the first member is locked in its lower position until jarred upwardly, in a manner to be described, in order to shear the pins 45.

The running tool 22 comprises a head 50 having an upper threaded end connectible to a wire line, and a lower tubular member 51 which is connected to and extends downwardly from the head. Pins 52 are carried within holes in the lower end of the member 51 for radial movement with respect thereto between an outer position, as shown in FIG. 1A, and an inner position as shown in FIG. 6. Outward movement of the pins beyond their outer position is limited by means of flanges about their inner ends.

The upper end of the first member 27 of the well tool has a locking recess 53 about its inner side which is adapted to receive the pins 52, in their outer positions, and a downwardly facing shoulder on the member 51 is adapted to seat upon the upper end 54 of the tubular member to locate the pins 52 just beneath a shoulder on the upper end of the recess 53. More particularly, a sleeve 55 is carried by the running tool for vertical reciprocation with respect thereto, and, when in its lower position, a surface about its outer side is within the inner ends of the pins 52 to hold them outwardly within the recess 52 whereby the first member is connected to the running tool for lowering therewith. During running of the well tool, sleeve 55 is held in its lower position by means of a coil spring 55A acting between it and the lower side of running tool head 50.

For a purpose to be described in detail to follow, a plug 56 is received within and releasably connected to the second member by means of shear pin 67 as the well tool is lowered into and locked in landed position within the nipple. When the running tool is connected to the first member of the well tool for lowering into the well string, the lower end of sleeve 55 carried by the running tool extends downwardly between the body of the well tool and the plug 56 so as to engage upon a shoulder on the plug and thereby prevent downward movement of the sleeve with respect to the plug and thus with respect to the second tubular member. Thus, upon release of the first member from the second member, and continued lowering of the wire line tool, pins 52 will move downwardly from about the cylindrical surface about the sleeve 55 and opposite a reduced diameter portion of the sleeve, as shown in FIG. 4A, so that the running tool is released from connection with the first member to permit it to be retrieved from the well tool. That is, as will be understood from FIG. 6, upon upward movement of the running tool with respect to the first member of the well tool, the shoulder at the upper end of recess 53 will force the pins 52 outwardly toward the reduced diameter portion of the sleeve, whereby the outer ends of the pins are free to slide upwardly within the first member above the recess 53.

The tubular member 51 of the running tool has windows 60 formed therein which permit access to the upper end of the sleeve 55 that so that, during assembly of the running tool with the well tool, it may be manually lifted against the force of the spring 55A in order to dispose pins 52 within recess 53, and then released to permit the sleeve to be moved by spring 55A into the lower position locking the pins 52 to the first tubular member. Obviously, the windows also permit the running tool to be disconnected from the well tool, should this be desired.

As shown in FIG. 1A, one or more ports 61 are formed in the second member of the well tool just beneath the lower end of the first tubular member, when the first tubular member is raised or extended with respect to the second tubular member, and just above an "O"-ring 62 carried on the inner diameter of the second member. Thus, well fluid is free to bypass through the ports 61 so as to permit the well tool to be lowered easily into the nipple. An "O"-ring 63 is also carried on the outer diameter of the first tubular member above the port 61 to form a sliding seal with the second member so that, as the first tubular member is lowered with respect to the second tubular member, its lower end is moved downwardly past seal ring 62 to close ports 61 (see FIG. 4A). Although additional ports 63A are formed in the lower end of the second member of the well tool to connect the exterior with the bore 66 thereof, seal rings 64 and 65 carried about the plug 56 are sealably engaged with the bore 66 above and below the inner ends of the ports 63A connect, whereby the well string is closed off by the well tool.

A conventional retrieving tool 68 is connectible to a fishing neck on the upper end of the plug 56, whereby an upward jar may be imparted to the plug for shearing the pins 67 and raising the plug to open the ports 63A and thus permit the well tool to be retrieved, even with well fluid thereabove. A retrieving tool 69 may then be releasably connected to the upper end of the first tubular member, as shown in FIG. 8, so as to impart an upward jar thereto in order to shear the pins 45 and thus permit the first tubular member of the well tool to be raised with respect to the second member thereof. As the first tubular member is raised with respect to the second tubular member, the surface 35 moves above the locking dogs to permit the locking dogs to retract into unlocking positions with respect to groove 24, and the upper end of "C"-ring 30 moves into engagement with the upper end of recess 31 so that the second member is again supported for lifting with the first member.

As shown in FIG. 8, as the first member is raised with respect to the second member, the normally expanded "C"-ring 38 is free to move outwardly into the recess 40 on the inner side of the second member, thereby reconnecting the first and second members in such a way as to limit downward movement of the first member with respect to the second member.

As shown in FIGS. 9 to 12, the second-described embodiment of well apparatus constructed in accordance with this invention comprises, as in the case of the first-described embodiment, a well conduit or nipple 81 adapted to be connected in a well string, a well tool 82 adapted to be releasably locked within the well conduit, and running and retrieving tools 83 and 84A for respectively lowering the well tool into and causing it to be locked within the well conduit and then retrieving the well tool from locked position within the well conduit. As in the case of the nipple 21, nipple 81 has a locking groove 82A formed about its inner diameter above a seal bore 83A and beneath an enlarged inner diameter 84A of the nipple. A downwardly and inwardly tapered seat 84B is formed in the second tubular member intermediate groove 82A and seal bore 83A.

As in the case of the first embodiment of the invention, the well tool 82 includes a body comprising a first tubular member 85 and a second tubular member 86, and normally retracted locking means 89 carried by the body. Also, a "C"-ring 87 carried by the first tubular member is received within an annular recess 88 of the second tubular member for vertical movement with respect thereto between an upper position in which the first and second members are extended and in which the upper end of the recess 88 is seated upon the "C"-ring 87 to support the second member from the first member, and a lower position in which the first member is contracted with respect to the second member so as to move the locking means into locking position, as will be described in connection with FIG. 10. In the second embodiment, however, the lower end of the first member is received about the upper end of the second member, and thus ring 87 is formed on the inside of the first member and recess 88 on the outside of the second member.

In this second embodiment of the invention, the normally retracted locking means comprises a "C"-ring 89 which is carried about the second tubular member and above a shoulder thereon, and beneath a downwardly and inwardly tapering wedging surface 90 on the lower end of the first member. As the first member moves downwardly with respect to the second member, wedge surface 90 moves within the "C"-ring 89 to force it outwardly, where it is held by means of a cylindrical surface 91 of the second member above the wedge surface 90 which moves within the "C"-ring as the first member reaches its limit of downward movement.

The running tool, and thus the first member lowerable with the running tool, are prevented from downward movement with respect to the second member, as the second member is lowered into the landing nipple, by means of a normally expanded "C"-ring 100 carried within a recess 101 about the running tool to bridge between the running tool and a recess 102 about the second member. More particularly, a series of sensing elements in the form of pins 103 are carried within holes of the second member for radial movement between outer sensing positions as shown in FIG. 9, and inner positions, when engaged with the seal bore 83A of the landing nipple, as shown in FIGS. 10 and 11. As the pins are urged inwardly, flanges on their inner ends forced the "C"-ring 100 inwardly into the recess 101 and thus out of the recess 102 in the second tubular member so that the running tool and thus the first member are released for downward movement with respect to the second member. As shown, an "O"-ring 105 is carried within recess 101 behind the "C" ring so as to hold it in a concentric position with respect to the recess.

As will be understood from the description of the first embodiment, as the well tool is lowered within the landing nipple, and the sensing elements move downwardly over seat 84B, they are urged inwardly to their retracted positions in which they are held by their engagement within the seal bore. At this time, the pins urge the "C"-ring inwardly to release the running tool and thus the first tubular member for downward movement with respect to the second tubular member, as shown in FIG. 10. During this downward movement of the running tool and first tubular member, a shoulder 106 about the second member and above the sensing elements 105 will land upon seat 84B in the nipple, whereby further downward movement of the first member and its wedge surface 90 forces the locking means 89 outwardly into groove 82A.

One or more pins 92 carried within holes in the second member for radial movement with respect thereto are urged inwardly by means of a surrounding "C"-ring 93. As in the case of the first embodiment, as the first member is lowered with respect to the second member, the inner ends of the pins 92 are slidable along a cylindrical surface 95 of the first member and into a groove 94 about the second member so as to lock the first member in its lowered position with respect to the second member.

As shown in FIG. 9, the first member 82 of the well tool is connected to the running tool 83 for lowering therewith by means of an upwardly facing shoulder 107 of the first tubular member which is disposed opposite a downwardly facing shoulder 108 on the running tool, and a normally expanded "C"-ring 109 which is carried within a recess 112 about the running tool for disposal within a gap formed between oppositely facing shoulders 110 and 111 on the first and second members, and thus bridge between the running tool and first member, when the first member is in a raised position with respect to the second member. As in the case of the "C"-ring 100, "C"-ring 109 is urged into a concentric position with respect to the running tool by means of an an "O"-ring 113 behind the "C"-ring, and is of such configuration that it will not expand outwardly beyond the position shown in FIG. 9, and thus will remain in its recess 112.

The shoulder 108 on the running tool is engageable with the shoulder 107 on the first member in order to cause the first member to be lowered therewith following release of the running tool from the second member and landing of the first member 86 on the nipple 81. Thus, as shown in FIG. 10, as the running tool and first member are so lowered, "C" ring 109 is compressed inwardly by the inner edge of shoulder 110, and the gap formed between shoulders 110 and 111 is closed sufficiently to prevent reentry of the "C"-ring 109. Also, since the sensing elements elements 103 are held inwardly by their engagement with the seal bore 83 of the landing nipple, the "C"-ring 100 is compressed into recess 101 and unable to reenter recess 107. Consequently, upon locking of the well tool in the nipple, the running tool 83, is released for retrieval. That is, both the upper and lower "C"-rings carried by the running tool will move upwardly past the gap and the recess in which they were disposed to bridge between and thus connect the running tool and the well tool during lowering of the well tool.

As in the case of the first embodiment of the invention, the well tool is shown to comprise a flow controlling device of some type, such as a plug carrying seal rings 113 about the second member 86 for engaging the seal bore 83A as the sensing elements are moved downwardly into engagement therewith. Obviously, however, as was also the case in the first embodiment, the plug and its seals may instead be formed on a part connectible to the second member of the well tool, or, for that matter, the well tool or some part connected to it may instead be a flow measuring device or the like not requiring sealed engagement with the seal bore. In installations of this latter type, wherein it is not required that the well tool seal with respect to the seal bore, the apparatus may be so designed that the sensing elements do not engage within the seal bore, but rather within another deliberately formed cylindrical bore within the landing nipple.

As shown in FIG. 12, the well tool may be retrieved from the landing nipple by means of a retrieving tool 84A adapted to be lowered into connection with the first member 82 in order to apply an upward jar to the upper member and thus shear pins 92 in order to release the first member from the second member for upward movement with respect thereto upon continued raising of the retrieving tool. Thus, the "C"-ring 87 carried by the first member is lifted into engagement with the shoulder of the upper end of recess 83 of the second member, as shown in FIG. 12, whereby, the locking ring 91 is permitted to return to retracted position, and upon continued lifting of the retrieving tool, the second member is lifted with the first member. As this occurs, the sensing elements 102 are of course raised out of engagement with the seal bore SB and the seal rings subsequently withdrawn therefrom.

The retrieving tool may be of any well known construction having, for example, locking dogs 121 adapted to be moved into engagement beneath a shoulder 122 at the upper end of a locking recess within the first member.

As also shown in the drawings, during retrieval of the well tool, the sensing elements 102 are prevented from accidentally falling through the bore of the tool by means of a "C"-ring 123 having a relaxed position in which it is disposed on the inner sides of the flanges of the sensing elements 103 and within the recesses 102 in which the flanges on the sensing elements are disposed.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. For use in a well string having a well conduit with a locking groove and a cylindrical bore, apparatus comprising a wire line running tool, a well tool including a body releasably connectible to the running tool for lowering therewith into the well string, locking means carried by the body in normally contracted position, sensing means carried by the body, and means responsive to movement of the sensing means into engagement with the bore for enabling the locking means to be expanded into the locking groove, and, when the locking means is so expanded, enabling the running tool to be released from connection to the body upon further manipulation of the running tool.

2. Apparatus of the character defined in claim 1, including means on the body to which a wire line retrieving tool may be connected, and means responsive to raising of the retrieving tool for causing said locking means to return to contracted position, whereby the well tool may be lifted from the well conduit with the retrieving tool.

3. Apparatus of the character defined in claim 2, including means automatically responsive to expansion of the locking means into locking position for holding it in such position, and means for releasing the holding means in response to jarring of the body through the retrieving tool.

4. For use in a well string having a well conduit with a locking groove and a cylindrical bore, apparatus comprising a wire line running tool, a well tool including a body releasably connectible to the running tool for lowering therewith into the well string, locking means carried by the body, means on the body which is shifted from a first to a second position to cause the locking means to be expanded from a normally retracted position into the locking groove, means for holding said shiftable means in the first position, sensing means carried by the body, means responsive to movement of the sensing elements into engagement with the bore for releasing said holding means, so that the shiftable means may be shifted to its second position upon further manipulation of the running tool, and means responsive to shifting of said shiftable means to its second position for releasing the running tool from connection to the body, whereby the running tool may be raised from the well tool.

5. Apparatus of the character defined in claim 4, including means on the body to which a wire line retrieving tool may be connected, and means responsive to raising of the retrieving tool for causing said locking means to return to contracted position, whereby the well tool may be lifted from the well conduit with the retrieving tool.

6. Apparatus of the character defined in claim 5, including means automatically responsive to expansion of the locking means into locking position for holding it in such position, and means for releasing the holding means in response to jarring of the body through the retrieving tool.

7. For use in a well string having a well conduit with a locking groove, a cylindrical bore and an upwardly facing seat, apparatus comprising a wire line running tool, a well tool including a body having a first member, means for connecting the first member to the running tool for lowering therewith into the well string, a second member supported from the first member for lowering therewith, locking means carried about the body in normally contracted position, means responsive to downward movement of the first member and the running tool with respect to the second member for causing the locking means to expand into locking groove, means preventing such downward movement of the second member, sensing means carried by the second member, means releasing said preventing means in response to movement of said sensing means into engagement with the bore, a shoulder on the second member for landing on the seat in the well conduit, in response to continued lowering of the second member following release of said preventing means, so that the first member and running tool may be lowered with respect to the second member in order to cause the locking means to be expanded into the locking groove, and means responsive to lowering of the first member and running tool with respect to the second member to expand the locking means into the locking groove for releasing the means for connecting the first member to the running tool to permit the running tool to be raised from the well tool.

8. Apparatus of the character defined in claim 7, including means on the first member to which a wireline retrieving tool may be connected in order to lift said first member with respect to the second member to cause said locking means to be returned to contracted position and said first member to be returned to a position supporting the second member, whereby the well tool and locking means may be lifted from the well conduit with the retrieving tool.

9. Apparatus of the character defined in claim 8, including means for automatically connecting the first member to the second member in response to lowering of the first member with respect to the second member to expand the locking means, said last-mentioned connecting means being releasable in response to jarring of the first member through the retrieving tool to permit the first member to be lifted with said retrieving tool.

10. Apparatus of the character defined in claim 7, wherein said preventing means comprises normally expanded latch means to bridge between the second member and one of the first member and running tool, the sensing means is yieldably urged outwardly by the latch means into sensing position, and said latch means is yieldable as the sensing means is forced inwardly upon movement into engagement with the bore to release said first member and running tool for lowering with respect to said second member.

11. Apparatus of the character defined in claim 7, wherein the expanding means comprises oppositely facing shoulders on the outer sides of the first and second members above and below the locking means, and one of said shoulders has a wedging surface to wedge the locking means outwardly as the shoulders move relatively toward one another.

12. Apparatus of the character defined in claim 7, wherein the lower end of the first member extends within the upper end of the second member, the preventing means comprises normally expanded latch means to bridge between the first and second members, the sensing elements are yieldably urged outwardly by the latch means to sensing positions, and said latch means is yieldably as the sensing means is forced inwardly upon movement into engagement with the bore to release said first member and running tool for lowering with respect to said second member.

13. Apparatus of the character defined in claim 12, wherein the running tool is seatable on the first member and includes latch means for shifting between latching and unlataching positions beneath a shoulder on the first member, and a sleeve is carried by the running tool for seating on means on the second member, said running tool being vertically shiftable with respect to the sleeve, between an upper position in which the latch means is held by the sleeve in latching position, and a lower position in which the latch means is released for movement to unlatching position.

14. Apparatus of the character defined in claim 7, wherein the lower end of the first member surrounds the upper end of the second member, the preventing means comprises normally expanded latch means to bridge between the running tool and second member, the sensing means is yieldably urged outwardly by the latch means to sensing positions, and said latch means is yieldable as the sensing means is forced inwardly upon movement into engagement with the bore to release said first member and running tool for lowering with respect to said second member.

15. Apparatus of the character defined in claim 14, wherein the running tool is seatable on the first member and includes normally expanded latch means disposed within a gap between shoulders on the first and second members, said latch means being contracted inwardly upon lowering of the first member and running tool with respect to the second member so as to release the running tool for removal from the well tool as the gap is decreased.

16. Apparatus of the character defined in claim 7, wherein the lower end of the first member is received within the upper end of the second member, a plug is seated on the lower end of the second member, and the lower end of the second member is closed except for first port means which is open to permit well fluid to flow therethrough as the well tool is being lowered and closed as the first member is lowered with respect to the second member, and second port means which is closed by the plug so that, with the first port means closed, the well tool closes the well conduit, said plug being liftable from the second member to open the second port means prior to retrieval of the well tool.

17. For use in a well string having a well conduit with a locking groove and a cylindrical bore, a well tool comprising, a body releasably connectible to a running tool for lowering therewith into the well string, locking means carried by the body in normally contracted position, sensing means carried by the body, and means responsive to movement of the sensing means into engagement with the bore for enabling the locking means to be expanded into the locking groove, and, when the locking means is so expanded, enabling the running tool to be released from connection to the body upon further manipulation of the running tool.

18. Apparatus of the character defined in claim 17, including means on the body to which a wire line retrieving tool may be connected, and means responsive to raising of the retrieving tool for causing said locking means to return to contracted position, whereby the well tool may be lifted from the well conduit with the retrieving tool.

19. Apparatus of the character defined in claim 18, including means automatically responsive to expansion of the locking means into locking position for holding it in such position, and means for releasing the holding means in response to jarring of the body through the retrieving tool.

20. For use in a well string having a locking groove and a cylindrical bore, a well tool comprising, a body releasably connectible to a running tool for lowering therewith into the well string, locking means carried by the body, means on the body which is shiftable from a first to a second position to cause the locking means to be expanded from a normally retracted position into the locking groove, means for holding said shiftable means in the first position, sensing means carried by the body, means responsive to movement of the sensing elements into engagement with the bore for releasing said holding means, so that the shiftable means may be so shifted to its second position upon further manipulation of the running tool, and means responsive to shifting of said shiftable means to its second position for releasing the running tool from connection to the body, whereby the running tool may be raised from the well tool.

21. Apparatus of the character defined in claim 20, including means on the body to which a wire line retrieving tool may be connected, and means responsive to raising of the retrieving tool for causing said locking means to return to contracted position, whereby the well tool may be lifted from the well conduit with the retrieving tool.

22. Apparatus of the character defined in claim 21, including means automatically responsive to expansion of the locking means into locking position for holding it in such position, and means for releasing the holding means in response to jarring of the body through the retrieving tool.

23. For use in a well string having a well conduit with a locking groove, a cylindrical bore and an upwardly facing seat, a well tool comprising a body having a first member, means by which the first member may be connected to the running tool for lowering therewith, a second member supported from the first member for lowering therewith and having an upper end which surrounds the lower end of the first member, locking means carried about the body in normally contracted position, means responsive to downward movement of the first member and the running tool with respect to the second member for causing the locking means to expand into locking groove, normally expanded latch means bridging between the first and second members to prevent such downward movement of the first member, sensing means carried by the second member and urged outwardly by the latch means to sensing position, said latch means being yieldable to release said first member for downward movement as the sensing means is forced inwardly upon movement into engagement with the bore, a shoulder on the second member for landing on the seat in the well conduit in response to continued lowering of the second member following release of said first member, so that the first member and running tool may be lowered with respect to the second member in order to cause the locking means to be expanded into the locking groove, and the means for connecting the first member to the running tool being releasable upon lowering of the first member and running tool with respect to the second member to expand the locking means into the locking groove, whereby the running tool may be raised from the well tool.

24. Apparatus of the character defined in claim 23, including means on the first member to which a wireline retrieving tool may be connected in order to lift said first member with respect to the second member to cause said locking means to be returned to contracted position and said first member to be returned to a position supporting the second member, whereby the well tool and locking means may be lifted from the well conduit with the retrieving tool.

25. Apparatus of the character defined in claim 24, including means for automatically connecting the first member to the second member in response to lowering of the first member with respect to the second member to expand the locking means, said last-mentioned connecting means being releasable in response to jarring of the first member through the retrieving tool to permit the first member to be lifted with said retrieving tool.

26. Apparatus of the character defined in claim 23, wherein the expanding means comprises opposite facing shoulders on the outer sides of the first and second members above and below the locking means, and one of said shoulders has a wedging surface to wedge the locking means outwardly as the shoulders move relatively toward one another.

27. For use in a well string having a well conduit with a locking groove, a cylindrical bore and an upwardly facing seat, a well tool comprising a body having a first member, means by which the first member may be connected to a running tool for lowering therewith into the well string, a second member supported from the first member for lowering therewith and having an upper end which is surrounded by the lower end of the first member, locking means carried about the body in normally contracted position, means responsive to downward movement of the first member and the running tool with respect to the second member for causing the locking means to expand into locking groove, the inner side of the second member having a groove adapted to receive normally expanded latch means carried by the running tool so as to bridge between the running tool and second member and thereby prevent such downward movement, sensing means carried by the second member and urged outwardly by the latch means to sensing position, whereby upon yielding of said latch means in response to inward movement of the sensing means upon movement into engagement with the bore, the running tool is released from the second member so as to permit the first member to be lowered with the running tool, and a shoulder on the second member for landing on the seat in the well conduit in response to continued lowering of the second member following release of said first member, so that the first member and running tool may be lowered with respect to the second member in order to cause the locking means to be expanded into the locking groove, the means by which the first means may be connected to the running tool including spaced shoulders on the first and second members in which another normally expanded latch member on the running tool may be received, whereby lowering of the first member and running tool with respect to the second member to expand the locking means into the locking groove will yieldably urge the other latch means out of the groove and thereby disconnect the first member therefrom to permit the running tool to be raised from the well tool.

28. Apparatus of the character defined in 27, including means on the first member to which a wireline retrieving tool may be connected in order to lift said first member with respect to the second member to cause said locking means to be returned to contracted position and said first member to be returned to a position supporting the second member, whereby the well tool and locking means may be lifted from the well conduit with the retrieving tool.

29. Apparatus of the character defined in claim 28, including means for automatically connecting the first member to the second member in response to lowering of the first member with respect to the second member to expand the locking means, said last-mentioned connecting means being releasable in response to jarring of the first member through the retrieving tool to permit the first member to be lifted with said retrieving tool.

30. Apparatus of the character defined in claim 27, wherein the expanding means comprises oppositely facing shoulders on the outer sides of the first and second members above and below the locking means, and one of said shoulders has a wedging surface to wedge the locking means outwardly as the shoulders move relatively toward one another.

31. For use in a well string having a well bore conduit with a locking groove and a cylindrical bore, a well tool comprising, a body releasably connectible to a running tool for lowering therewith into the well string, locking means carried by the body, sensing means carried by the body, and means responsive to movement of the sensing means into engagement with the bore for enabling the locking means to be expanded into the locking groove.

32. Apparatus of the character defined in claim 31, including means on the body to which a wire line retrieving tool may be connected, and means responsive to manipulation of the retrieving tool for causing said locking means to return to the contracted position, whereby the well tool may be lifted from the well conduit with the retrieving tool.

33. Apparatus of the character defined in claim 31, including means automatically responsive to expansion of the locking means into a locking position for holding it in such position.

34. For use in a well string having a locking groove and a cylindrical bore, a well tool comprising, a body releasably connectible to a running tool for lowering therewith into the well string, locking means carried by the body, means on the body which is shiftable from a first to a second position to cause the locking means to be expanded from a normally retracted position into the locking groove, means for holding said shiftable means in the first position, sensing means carried by the body, and means responsive to movement of the sensing elements into engagement with the bore for releasing said holding means, so that the shiftable means may be so shifted to its second position upon further manipulation of the running tool.

35. Apparatus of the character defined in claim 34, including means on the body to which a wire line retrieving tool may be connected, and means responsive to manipulation of the retrieving tool for causing said locking means to return to contracted position, whereby the well tool may be lifted from the well conduit with the retrieving tool.

36. Apparatus of the character defined in claim 34, including means automatically responsive to expansion of the locking means into locking position for holding it in such position.

37. For use in a well string having a well conduit with a locking groove, a cylindrical bore and an upwardly facing seat, a well tool comprising a body having a first member, means by which the first member may be connected to the running tool for lowering therewith, a second member supported from the first member for lowering therewith and having an upper end which surrounds the lower end of the first member, locking means carried about the body in normally contracted position, means responsive to downward movement of the first member and the running tool with respect to the second member for causing the locking means to expand into locking groove, normally expanded latch means bridging between the first and second members to prevent such downward movement of the first member, sensing means carried by the second member and urged outwardly by the latch means to sensing position, said latch means being yieldable to release said first member for downward movement as the sensing means is forced inwardly upon movement into engagement with the bore, and a shoulder on the second member for landing on the seat in the well conduit in response to continued lowering of the second member following release of said first member, so that the first member and running tool may be lowered with respect to the second member in order to cause the locking means to be expanded into the locking groove.

38. Apparatus of the character defined in claim 37, including means on the first member to which a wireline retrieving tool may be connected in order to lift said first member with respect to the second member to cause said locking means to be returned to contracted position and said first member to be returned to a position supporting the second member, whereby the well tool and locking means may be lifted from the well conduit with the retrieving tool.

39. Apparatus of the character defined in claim 37, including means for automatically connecting the first member to the second member in response to lowering of the first member with respect to the second member to expand the locking means.

40. Apparatus of the character defined in claim 37, wherein the expanding means comprises opposite facing shoulders on the outer sides of the first and second members above and below the locking means, and one of said shoulders has a wedging surface to wedge the locking means outwardly as the shoulders move relatively toward one another.

41. For use in a well string having a well conduit with a locking groove, a cylindrical bore and an upwardly facing seat, a well tool comprising a body having a first member, means by which the first member may be connected to a running tool for lowering therewith into the well string, a second member supported from the first member for lowering therewith and having an upper end which is surrounded by the lower end of the first member, locking means carried about the body in normally contracted position, means responsive to downward movement of the first member and the running tool with respect to the second member for causing the locking means to expand into locking groove, the inner side of the second member having a groove adapted to receive normally expanded latch means carried by the running tool so as to bridge between the running tool and second member and thereby prevent such downward movement, sensing means carried by the second member and urged outwardly by the latch means to sensing position, whereby upon yielding of said latch means in response to inward movement of the sensing means upon movement into engagement with the bore, the running tool is released from the second member so as to permit the first member to be lowered with the running tool, and a shoulder on the second member for landing on the seat in the well conduit in response to continued lowering of the second member following release of said first member, so that the first member and running tool may be lowered with respect to the second member in order to cause the locking means to be expanded into the locking groove.

42. Apparatus of the character defined in claim 41, including means on the first member to which a wireline retrieving tool may be connected in order to lift said first member with respect to the second member to cause said locking means to be returned to contracted position and said first member to be returned to a position supporting the second member, whereby the well tool conduit with the retrieving tool.

43. Apparatus of the character defined in claim 41, including means for automatically connecting the first member to the second member in response to lowering of the first member with respect to the second member to expand the locking means.

44. Apparatus of the character defined in claim 41, wherein the expanding means comprises oppositely facing shoulders on the outer sides of the first and second members above and below the locking means, and one of said shoulders has a wedging surface to wedge the locking means outwardly as the shoulders move relatively toward one another.

45. For use in a well string having a well conduit with opposed locking shoulders and a cylindrical bore, apparatus comprising a wire line running tool, a well tool including a body releasably connectible to the running tool for lowering therewith into the well string, locking means carried by the body in normally contracted position, sensing means carried by the body, and means responsive to movement of the sensing means into engagement with the bore for enabling the locking means to be expanded into the locking position with respect to the locking shoulders.

46. Apparatus of the character defined in claim 45, including means on the body to which a wire line retrieving tool may be connected, and means responsive to raising of the retrieving tool for causing said locking means to return to contracted position, whereby the well tool may be lifted from the well conduit with the retrieving tool.

47. Apparatus of the character defined in claim 46, including means automatically responsive to expansion of the locking means into locking position for holding it in such position, and means for releasing the holding means in response to jarring of the body through the retrieving tool.

48. For use in a well string having a well conduit with opposed locking shoulders and a cylindrical bore, apparatus comprising a wire line running tool, a well tool including a body releasably connectible to the running tool for lowering therewith into the well string, locking means carried by the body, means on the body which is shiftable from a first to a second position to cause the locking means to be expanded from a normally retracted position into a locking position with respect to the shoulders, means for holding said shiftable means in the first position, sensing means carried by the body, and means responsive to movement of the sensing means into engagement with the bore for releasing said holding means, so that the shiftable means may be shifted to its second position upon further manipulation of the running tool.

49. Apparatus of the character defined in claim 48, including means on the body to which a wire line retrieving tool may be connected, and means responsive to raising of the retrieving tool for causing said locking means to return to contracted position, whereby the well tool may be lifted from the well conduit with the retrieving tool.

50. Apparatus of the character defined in claim 49, including means automatically responsive to expansion of the locking means into locking position for holding it in such position, and means for releasing the holding means in response to jarring of the body through the retrieving tool.

51. For use in a well string having a well conduit with opposed locking shoulders, a cylindrical bore and a upwardly facing seat, apparatus comprising a well tool including a body having a first member, means for connecting the first member to a running tool for lowering therewith into the well string, a second member supported from the first member for lowering therewith, locking means carried about the body in normally contracted position, means responsive to downward movement of the first member and the running tool with respect to the second member for causing the locking means to expand into locking position with respect to the shoulders, means preventing such downward movement of the second member, sensing means carried by the second member, means releasing said preventing means in response to movement of said sensing means into engagement with the bore, a shoulder on the second member for landing on the seat in the well conduit, in response to continued lowering of the second member following release of said preventing means, so that the first member and running tool may be lowered with respect to the second member in order to cause the locking means to be expanded, and means responsive to lowering of the first member and running tool with respect to the second member to expand the locking means for releasing the means for connecting the first member to the running tool to permit the running tool to be raised from the well tool.

52. Apparatus of the character defined in claim 51, including means on the first member to which a wire line retrieving tool may be connected in order to lift said first member with respect to the second member to cause said locking means to be returned to contracted position and said first member to be returned to a position supporting the second member, whereby the well tool and locking means may be lifted from the well conduit with the retrieving tool.

53. Apparatus of the character defined in claim 52, including means for automatically connecting the first member to the second member in response to lowering of the first member with respect to the second member to expand the locking means, said last-mentioned connecting means being releasable in response to jarring of the first member through the retrieving tool to permit the first member to be lifted with said retrieving tool.

54. Apparatus of the character defined in claim 51, wherein said preventing means comprises normally expanded latch means to bridge between the second member and one of the first member and running tool, the sensing means is yieldably urged outwardly by the latch means into sensing position, and said latch means is yieldable as the sensing means is forced inwardly upon movement into engagement with the bore to release said first member and running tool for lowering with respect to said second member.

55. Apparatus of the character defined in claim 51, wherein the expanding means comprises oppositely facing shoulders on the outer sides of the first and second members above and below the locking means, and one of said shoulders has a wedging surface to wedge the locking means outwardly as the shoulders move relatively toward one another.

* * * * *